US010815637B2

(12) United States Patent
Panni et al.

(10) Patent No.: US 10,815,637 B2
(45) Date of Patent: Oct. 27, 2020

(54) ARM ASSEMBLY

(71) Applicant: J.C. BAMFORD EXCAVATORS LIMITED, Uttoxeter (GB)

(72) Inventors: David Craig Panni, Uttoxeter (GB); Jamie Thomas Lewis Shenton, Uttoxeter (GB); Niall Benjamin Seigler, Uttoxeter (GB); Luke Wood, Uttoxeter (GB)

(73) Assignee: J.C. BAMFORD EXCAVATORS LIMITED, Uttoxeter, Staffordshire (GB)

( * ) Notice: Subject to any disclaimer, the term of this patent is extended or adjusted under 35 U.S.C. 154(b) by 0 days.

(21) Appl. No.: 15/844,458

(22) Filed: Dec. 15, 2017

(65) Prior Publication Data

US 2018/0202125 A1 Jul. 19, 2018

(30) Foreign Application Priority Data

Dec. 16, 2016 (GB) ..... 1621521.2

(51) Int. Cl.
*E02F 3/38* (2006.01)
*E02F 3/32* (2006.01)

(52) U.S. Cl.
CPC . *E02F 3/38* (2013.01); *E02F 3/32* (2013.01)

(58) Field of Classification Search
CPC ..... E02F 3/38; E02F 3/32; E02F 3/40; E02F 3/369
See application file for complete search history.

(56) References Cited

U.S. PATENT DOCUMENTS

| | | | | |
|---|---|---|---|---|
| 3,254,780 | A | 6/1966 | Midtbo | |
| 3,722,864 | A | 3/1973 | Borer et al. | |
| 3,902,295 | A * | 9/1975 | Yancey | E02F 3/38 37/379 |
| 4,767,255 | A * | 8/1988 | Mickelson | E02F 3/32 414/695.5 |
| 7,648,149 | B2 * | 1/2010 | Ryberg | B60G 9/00 280/124.106 |
| 2004/0191043 | A1 * | 9/2004 | Davis | E02F 3/38 414/722 |
| 2006/0201274 | A1 * | 9/2006 | Nakajima | E02F 3/38 74/490.01 |
| 2008/0193269 | A1 * | 8/2008 | Sakada | E02F 3/34 414/722 |
| 2013/0051965 | A1 | 2/2013 | Bradley et al. | |

(Continued)

FOREIGN PATENT DOCUMENTS

| | | | |
|---|---|---|---|
| EP | 1154081 | A2 | 11/2001 |
| EP | 2 050 881 | A1 | 4/2009 |
| FR | 2 900 169 | A1 | 10/2007 |

(Continued)

OTHER PUBLICATIONS

Extended European Search Report for European Patent Application No. 17206805.8, dated May 22, 2018.
Search Report for GB 1621521.2, dated Mar. 28, 2017.

*Primary Examiner* — Michael S Lowe
(74) *Attorney, Agent, or Firm* — Marshall, Gerstein & Borun LLP

(57) ABSTRACT

An arm assembly for a working vehicle, the arm assembly including a material handling implement and an arm including a single plate.

8 Claims, 6 Drawing Sheets

(56) References Cited

U.S. PATENT DOCUMENTS

| | | | | |
|---|---|---|---|---|
| 2013/0058748 | A1* | 3/2013 | Springer | E02F 3/38 414/722 |
| 2013/0149095 | A1* | 6/2013 | Huissoon | B62D 33/0625 414/687 |

FOREIGN PATENT DOCUMENTS

| | | | |
|---|---|---|---|
| GB | 2 246 111 | A | 1/1992 |
| JP | 2006022580 | A | 1/2006 |
| KR | 1020080045317 | | 5/2008 |
| WO | WO-2007090452 | A1 | 8/2007 |
| WO | WO-2009/048028 | A1 | 4/2009 |

* cited by examiner

ARM ASSEMBLY

FIELD OF THE INVENTION

The present invention relates to an arm assembly for a working vehicle. More particularly, the present invention relates to an arm assembly including an improved arm. The present invention also relates to a working vehicle including an arm assembly including an improved arm.

BACKGROUND OF THE INVENTION

Working vehicles, such as excavators or backhoe loaders, include an arm assembly on which a material handling implement is mounted.

Known arm assemblies have a first arm, known as a boom, pivotally mounted about a generally horizontal axis relative to a chassis of the working vehicle. A further arm, also known as a dipper or stick, may be attached to an end of the boom remote from the chassis, the dipper arm being pivotable about a generally horizontal axis. A material handling implement, for example a bucket, may be pivotably mounted on an end of the dipper arm remote from the boom. The boom may be raised and lowered by operation of a first hydraulic ram. The dipper arm may be movable relative to the boom by operation of a second hydraulic ram. The bucket may be movable relative to the dipper arm by operation of a third hydraulic ram.

Triple articulated booms are also known. Such arm assemblies include a two-part boom having a lower boom that is pivotably mounted about a generally horizontal axis relative to the chassis of the working vehicle, and an upper boom that is attached to an end of the lower boom that is remote from the chassis, the upper boom being pivotable about a generally horizontal axis. Such a triple articulated boom also includes an arm or dipper that is attached to an end of the upper boom that is remote from the lower boom. A material handling implement, for example a bucket, may be pivotably mounted on an end of a dipper arm remote from the upper boom. The lower boom may be raised and lowered by operation of a first hydraulic ram. The upper boom may be moveable relative to the lower boom by operation of a second hydraulic ram. The dipper arm may be movable relative to the upper boom by operation of a third hydraulic ram. The bucket may be moveable relative to the dipper arm by operation of a fourth hydraulic ram.

Conventional dipper arms are constructed by welding top and bottom plates to two side walls or plates and welding bosses to the side walls. The cross section of these dipper arms are tapered box sections.

It is known for dipper arms to also include additional connectors, for example plates, to which the hydraulic rams or material handling implements, for example thumbs, may be mounted. Such connectors or plates are also welded to the dipper arm structure.

Whilst such dipper arms can be both strong and of low weight and low inertia, care is required during welding to avoid the introduction or creation of concentrations of stress, which may result in failure of the weld or parent material in use.

UK patent application published as GB2246111 describes a dipper arm formed from a high strength polymeric composite material having a box-shaped structure including an outer casing member formed of a high strength polymeric composite material and an inner filler comprising polyurethane foam.

SUMMARY OF THE INVENTION

There is a demand to further reduce the weight of vehicles in order to reduce cost and improve fuel efficiency, machine controllability and/or productivity while retaining the required physical properties to withstand the loads (e.g. bending and torsional loads) that are experienced during operation of the arm assembly. It is also desired to provide working arms for vehicles that are less complex to manufacture and that are more durable.

According to a first aspect of the present invention there is provided an arm assembly for a working vehicle, the arm assembly including a material handling implement and an arm including a single plate.

The single plate is a unitary planar structure, for example the single plate may be manufactured from a single, solid, component. This is in contrast to conventional arm structures that are formed as box sections. The single plate may be fabricated, cast, formed or forged from a single material, for example from a single metallic or metal-containing material.

The single plate may include at least one cut out. One or more of the at least one cut outs may be formed in a central portion of the single plate.

The single plate may further include a mount, for example a ram mount. The mount may be a clevis eye-end.

Additionally or alternatively, the single plate may include a boss for connection to the material handling implement. The single plate may further include at least one torsion member, the at least one torsion member being mounted adjacent to a lower edge of the single plate. The boss may be positioned on one of the at least one torsion members. The at least one torsion member may have a first torsion member end and a second torsion member end and the boss for connection to the material handling implement may be located at or adjacent to the first torsion member end.

The boss for connection to the material handling implement may be a first boss, the at least one torsion member further including a second boss at or adjacent to the second torsion member end. Each of the bosses may include an opening that is co-located with a corresponding opening in the single plate.

The single plate may also include a connector for connection to an attachment. The connector may be arranged for direct connection to the attachment.

The single plate may have a laminate structure and include a first plate layer and at least one further plate layer, the first plate layer and the at least one further plate layer being arranged to form the single plate.

Each of the plate layers may be manufactured from a single, solid component. This is contrast to conventional arm structures that are formed as box sections. At least one of the plate layers may be fabricated, cast, formed or forged from a single material, for example from a single metallic or metal-containing material.

The arm may be a dipper arm.

The arm assembly may further include a boom.

According to another aspect of the invention there is provided a working vehicle including ground engaging means, an operator's cab and an arm assembly according to the first aspect of the invention.

BRIEF DESCRIPTION OF THE DRAWINGS

Embodiments of the present invention will now be described with reference to the accompanying drawings in which.

DETAILED DESCRIPTION OF THE INVENTION

Figure 1:
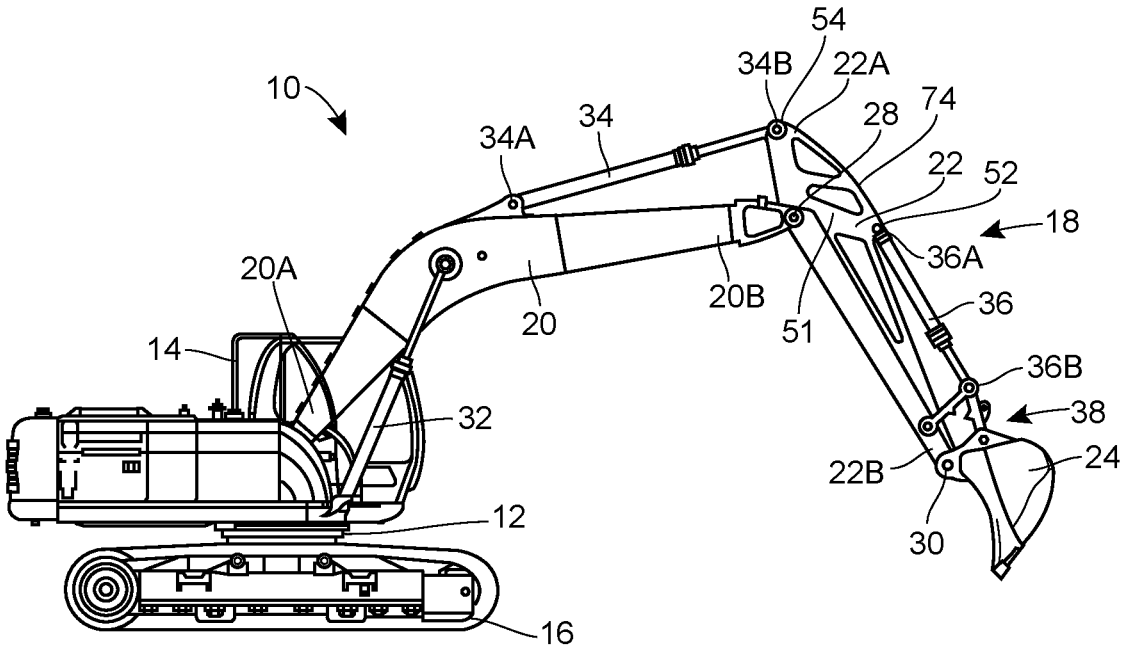
FIG. 1 is an excavator including an arm assembly according to a first embodiment of the present invention.

With reference to FIG. 1, there is shown a working vehicle 10, which in this example is an excavator. The working vehicle 10 includes a chassis 12 and an operator cab 14. The operator cab 14 is mounted on the chassis 12. Ground engaging transport means in the form of a pair of tracks 16 are provided to move the working vehicle 10.

Attached to the chassis 12 is an arm assembly 18 (also known as an implement support system). The arm assembly 18 includes a first arm in the form of a boom 20, a second arm in the form of a dipper arm 22 and a material handling implement in the form of a bucket 24.

The arm assembly 18 further includes a first hydraulic actuator in the form of a first hydraulic ram 32, a second hydraulic actuator in the form of a second hydraulic ram 34 and a third hydraulic actuator in the form of a third hydraulic ram 36. A connector, for example a clevis, may be included at one or both ends of one or more of the first hydraulic ram 32, the second hydraulic ram 34 and/or the third hydraulic ram 36. As shown in FIG. 1, the arm assembly 18 includes a single hydraulic ram 32. In alternative embodiments of the invention, the arm assembly 18 may include a pair of hydraulic rams positioned side-by-side instead of the single hydraulic ram 32.

The clevis may be cast or forged and is joined to the end of the hydraulic ram 32, 34, 36 by arc welding, friction welding, laser or laser-hybrid arc welding or via a threaded joint.

In some examples, the clevis may have a machined opening or hole located perpendicular to the axis of the hydraulic ram. The machined opening or hole is configured to allow a pin to slide through, the pin accommodating articulation and the joining of the hydraulic ram to other components, for example the dipper arm 22. The pin is used to hold the single plate 40 of the dipper arm 22 in place and to prevent it sliding out of position during use. The retention means for retaining the pin may be any one of a locking collar that accommodates a cross bolt to be bolted through the pin and the clevis, a pear plate that is welded to one end of the pin, with a bolt fixing the pear plate to the clevis and an E clip that is located in a recess on the pin.

Figure 2:
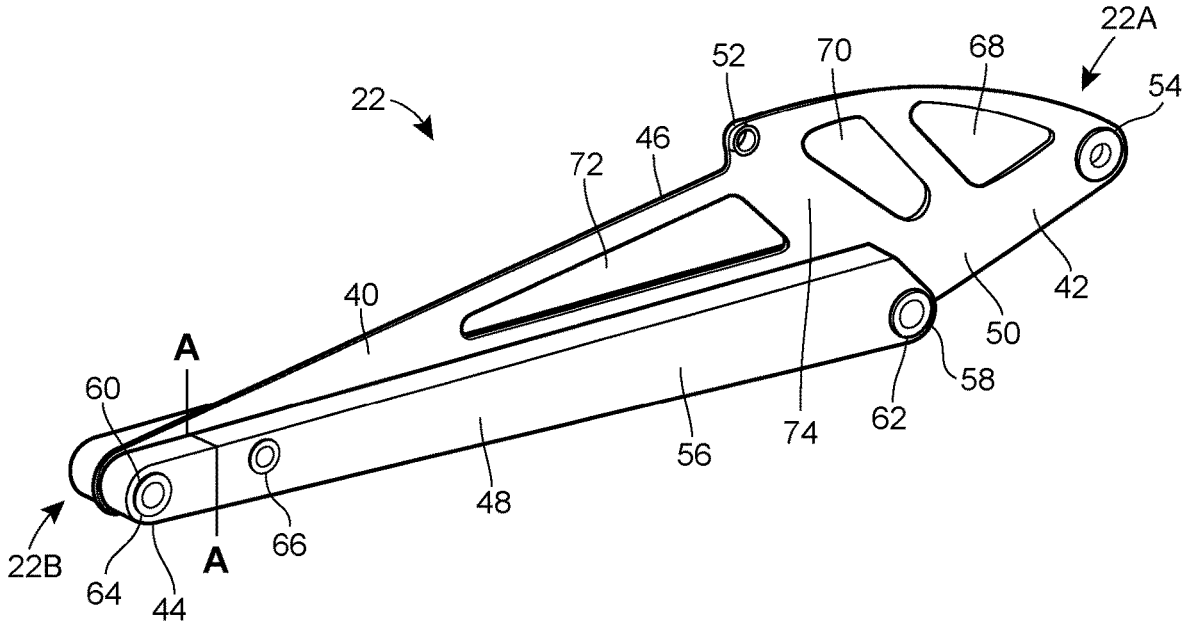
FIG. 2 is the dipper arm of the arm assembly of FIG. 1.

With reference to FIG. 2, the dipper arm 22 is defined by a centrally-located single plate (i.e., a planar structural member) 40 having a first end 42 corresponding to the first end 22A of the dipper arm 22 and a second end 44 corresponding to the second end 22B of the dipper arm 22. The single plate 40 has an upper surface 46, a lower surface 48 an outer face 50 and an inner face 51 (not shown in FIG. 2 but visible in FIGS. 1 and 3A-3D). The dipper arm 22 is manufactured from a single solid component. The dipper arm 22 is made by fabrication, casting, forming or forging the single plate from a single material, for example a metallic or metal-containing material.

Figure 5:
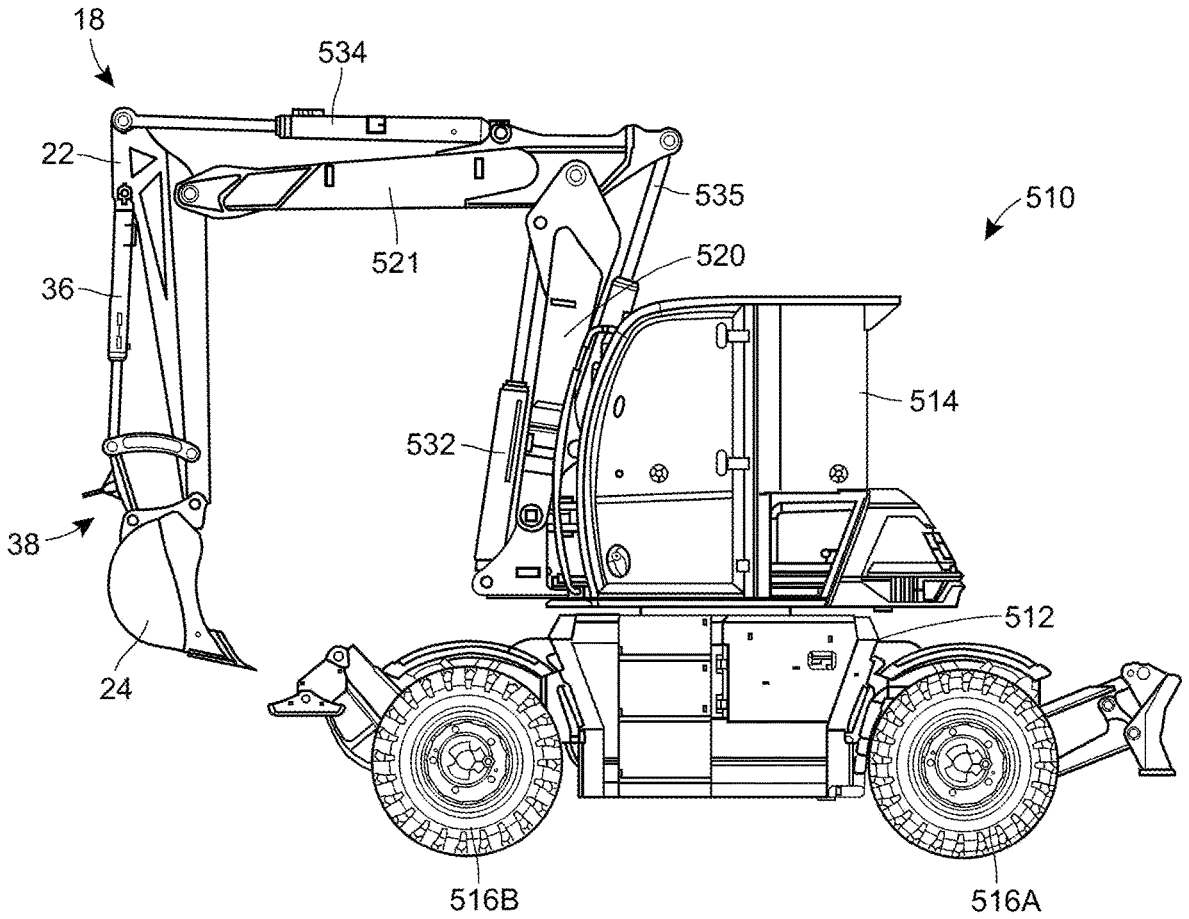
FIG. 5 is a wheeled excavator including a triple articulated boom having an arm assembly according to an alternative embodiment of the invention.
Figure 6:
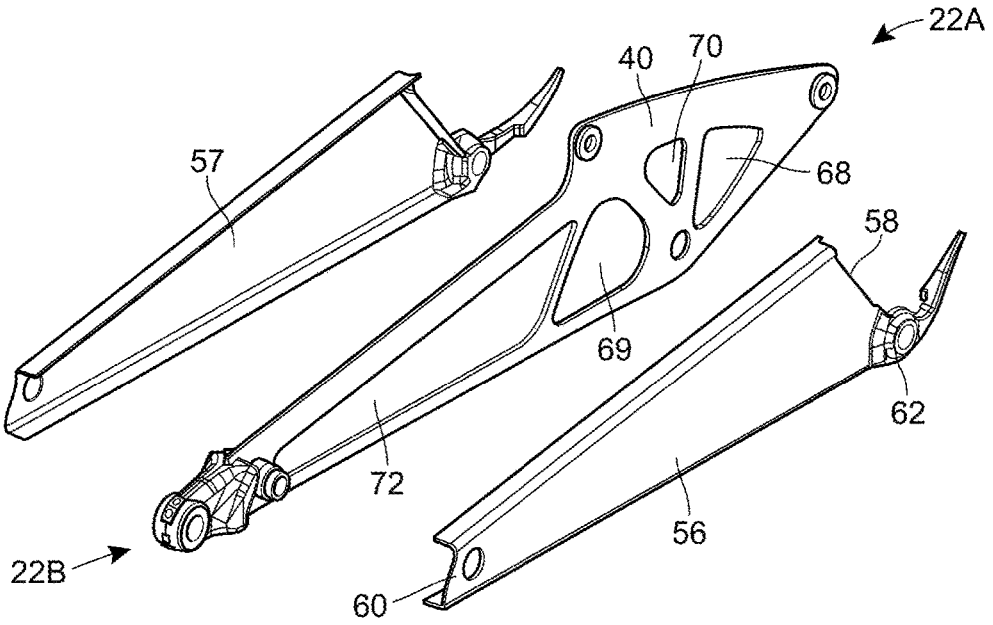
FIG. 6 is an exploded view of a dipper arm of an arm assembly according to an alternative embodiment of the present invention.
Figure 7:
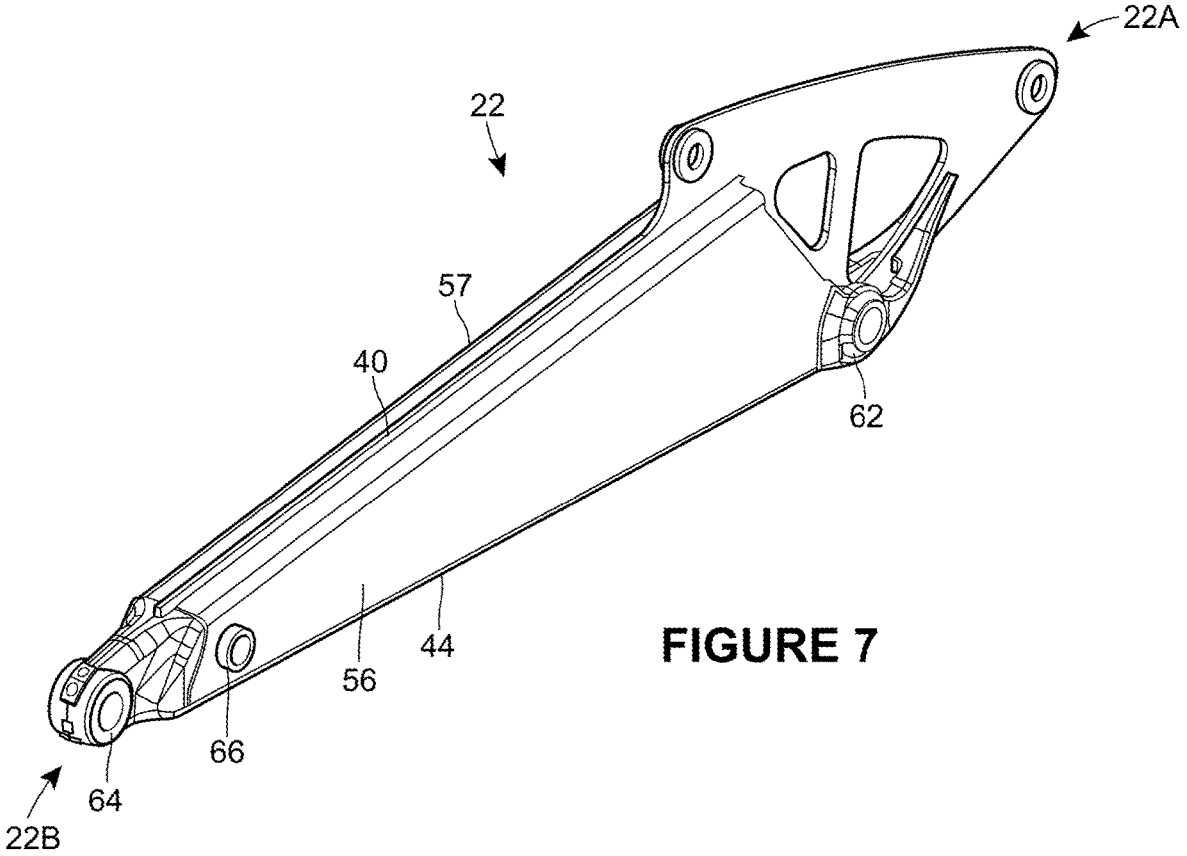
FIG. 7 is an alternative view of the dipper arm of FIG. 6.

In some embodiments, the single plate 40 includes a doubler or reinforcing plate or torsion member 56 to increase the width and bearing area, along with shims or spacers, to prevent side to side movement of the clevis on the pin, as shown in FIGS. 5 and 6. In some embodiments, the single plate 40 includes a pair of doublers or reinforcing plates or torsion members 56, 57 to increase the width and bearing area. The doubler(s) or reinforcing plate(s) or torsion member(s) 56, 57 are made by fabrication, casting, forming or forging the doubler or reinforcing plate from a single material, for example a metallic or metal-containing material.

The single plate 40 includes a ram mount 52 in the form of a clevis eye-end adjacent to the upper surface 46 part way between the first 42 and second 44 ends of the single plate 40. The single plate 40 includes a further ram mount 54 in the form of a clevis eye-end adjacent the first end 42 of the single plate. The clevis eye-ends may be cast, forged or fabricated.

The single plate 40 includes an elongate torsion member 56 that is mounted on the outer face 50 of the single plate 40.

The torsion member 56 has a first end 58 and a second end 60. The torsion member 56 has a first boss or node 62 adjacent to the first end 58 of the torsion member 56, a second boss or node 64 adjacent to the second end 60 of the torsion member 56 and a third boss or node 66 that is positioned between the first boss 62 and the second boss 64, proximate to the second boss 64. The single plate 40 and the torsion member 56 include openings (not shown) that are positioned to correspond to openings in each of the first boss 62, the second boss 64 and the third boss 66. Each of the first boss 62, the second boss 64 and/or the third boss 66 may be fabricated, cast or forged.

Figure 3A:
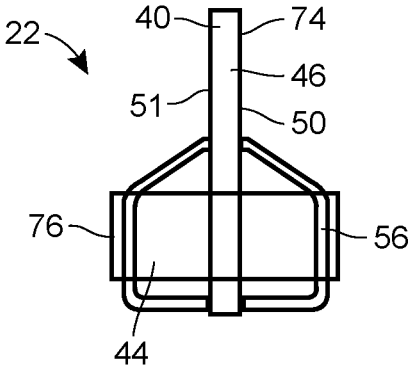
FIG. 3A is a cross section through line A-A of FIG. 2.

Referring now to FIG. 3A, a cross section through the arm 22 through line A-A as shown in FIG. 2 is shown. The arm 22 has a first torsion member 56 on one side of the plate 40 and a second torsion member 76 on an opposite side of the single plate 40.

Figure 3B:
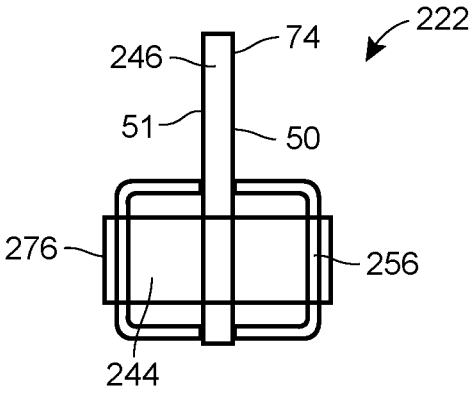
FIG. 3B is a cross section through line A-A of FIG. 2 according to an alternative embodiment of the invention.
Figure 3C:
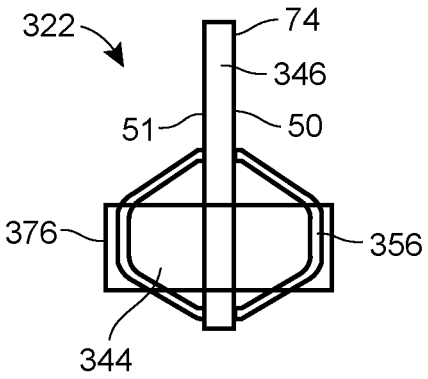
FIG. 3C is a cross section through line A-A of FIG. 2 according to an alternative embodiment of the invention.
Figure 3D:
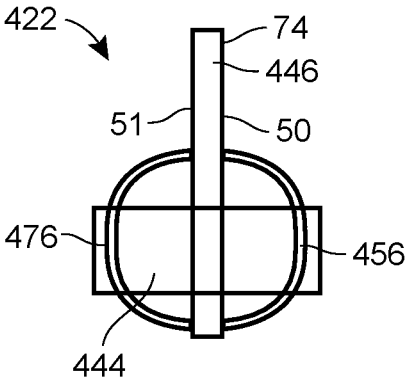
FIG. 3D is a cross section through line A-A of FIG. 2 according to an alternative embodiment of the invention.

Now referring to FIGS. 3B, 3C and 3D, there are shown alternative embodiments of the invention in which the walls of the torsion members form a different cross section.

The single plate 40 also includes three cut outs 68, 70, 72 that extend through the outer face 50 and the inner face (not shown) of the single plate 40. Each of the cut outs 68, 70, 72 is located along a central portion or spine 74 that is defined between the first end 42, the second end 44, the upper surface 46 and the lower surface 48 of the single plate 40. As shown in FIG. 6, the single plate 40 has a fourth cut out 69.

Figure 4A:
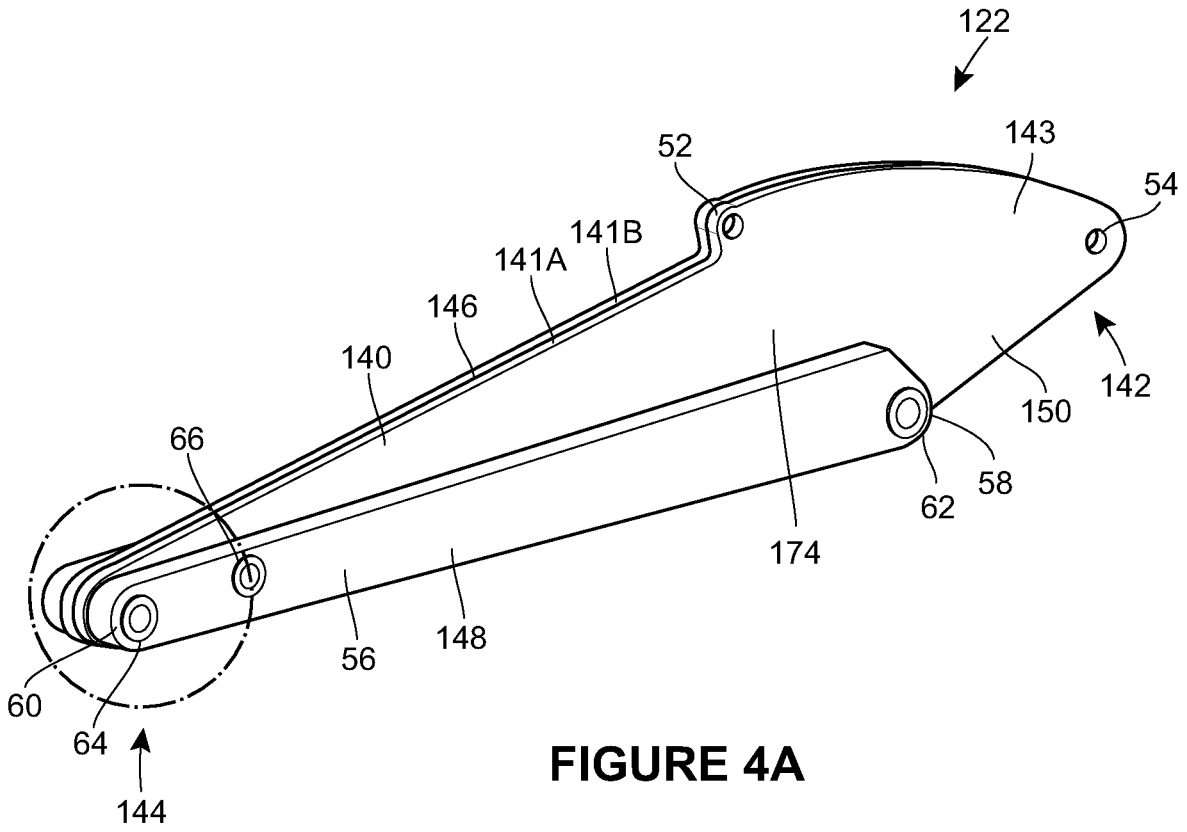
FIG. 4A is an alternative dipper arm for use in conjunction with the arm assembly of the present invention.
Figure 4B:
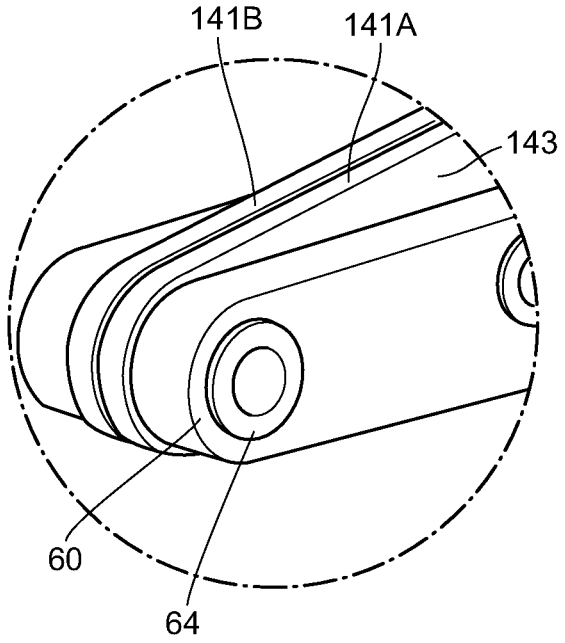
FIG. 4B is a partial view of the alternative dipper arm of FIG. 4A.

A dipper arm 122 according to an alternative embodiment of the invention will now be described with particular reference to FIGS. 4A and 4B. Features in common with the first embodiment are depicted with the same reference number.

The dipper arm 122 is defined by a single plate 140 having a first end 142 corresponding to the first end 22A of the dipper arm 122 and a second end 144 corresponding to the second end 22B of the dipper arm 122. The single plate 140 has an upper surface 146 and a lower surface 148.

The single plate 140 has a laminate structure and includes a first plate layer 141A and a second plate layer 141B. The first plate layer 141A includes an outer face 143 and an inner face (not shown). The second plate layer 141B includes an inner face (not shown) and an outer face (not shown). The second plate layer 141B is mounted on the first plate layer 141A such that the inner face (not shown) of the first plate layer 141A abuts the inner face (not shown) of the second plate layer 141B. The first plate layer 141A and the second plate layer 141B are fastened together by welding or other suitable means, for example by adhesive.

Each of the first plate layer 141A and the second plate layer 141B is manufactured from a single, solid component. At least one of the first plate layer 141A and the second plate layer 141B is made by fabrication, casting, forming or forging the plate layer 141A, 141B from a single material, for example a metallic or metal-containing material.

The single plate 140 includes a ram mount 52 in the form of a clevis eye-end adjacent to the upper surface 146 part way between the first 142 and second 144 ends of the single plate 140. The single plate 140 includes a further ram mount 54 in the form of a clevis eye-end adjacent the first end 142 of the single plate.

The single plate 140 includes an elongate torsion member 56, that is mounted on the outer face 150 of the single plate 140.

The torsion member 56 has a first end 58 and a second end 60. The torsion member 56 has a first boss 62 adjacent to the first end 58 of the torsion member 56, a second boss 64 adjacent to the second end 60 of the torsion member 56 and a third boss 66 that is positioned between the first boss 62 and the second boss 64 proximate to the second boss 64. Each of the first plate layer 141A and the second plate layer 141B and the torsion member 56 include openings (not shown) that are positioned to correspond to openings in each of the first boss 62, the second boss 64 and the third boss 66.

The second boss 64 may be formed as a single casting or forging that enables a quick hitch (not shown) to be used with the dipper arm 22.

Except for the mounts 52 and 54, the single plate 140 of this embodiment includes ram mounts 52 and 54, but does not include any cut outs, such as the cut outs 68, 70 or 72 shown in FIG. 2.

Assembly of the arm assembly 18 will now be described.

With reference to FIG. 1, the boom 20 is pivotally mounted by pivot to link at a first end 20A of the boom 20. A link is pivotally mounted at a generally vertical axis relative to the chassis 12. A pivot is orientated horizontally. A first end 22A of the dipper arm 22, 122 is pivotally mounted via pivot 28 (that is co-located with the first boss 62) to a second end 20B of the boom 20. Pivot 28 is orientated horizontally. The bucket 24 is pivotally mounted via pivot 30 (that is co-located with the second boss 64) to a second end 22B of the dipper arm 22, 122.

The first hydraulic ram 32 has a first end pivotally attached to the chassis 12 and a second end pivotally attached to the boom 20 part way between the first 20A and second 20B ends of the boom 20. A second hydraulic actuator in the form of a second hydraulic ram 34 has a first end 34A pivotally attached to the boom 20 part way between the first 20A and second 20B ends of the boom 20 and a second end 34B pivotally attached to the dipper arm 22, 122 proximate the first end 22A of the dipper arm 22, 122. The second end 34B of the second hydraulic ram 34 includes a clevis that connects to the clevis eye-end 54 on the dipper arm 22, 122. A third hydraulic actuator in the form of a third hydraulic ram has a first end pivotally attached to the dipper arm 22, 122 proximate the first end 22A of the dipper arm 22, 122 and a second end pivotally attached to a linkage mechanism 38 proximate the second end 22B of the dipper arm 22, 122. The first end of the third hydraulic ram includes a clevis that connects to the clevis eye-end 52 on the dipper arm 22, 122. The linkage mechanism 38 per se is known and simply converts extension and retraction movement of the third hydraulic ram (not shown) into rotary movement of the bucket 24 about pivot 30.

Operation of the arm assembly 18 will now be described with reference to FIG. 1.

The first 32, second 34 and third (not shown) hydraulic rams are all double acting hydraulic rams. Double acting hydraulic rams are known per se. They include a piston within a cylinder. The piston is attached to a rod which extends beyond the end of the cylinder. The end of the rod remote from the piston defines one end of the hydraulic ram. The end of the cylinder remote from the rod defines an opposite end of the hydraulic ram. A "head side chamber" is defined between the piston and the end of the cylinder remote from the head. A "rod side chamber" is defined between the piston and the end of the cylinder proximate the end of the rod. Pressurisation of the head side pressure chamber extends the ram and pressurisation of the rod side chamber causes the ram to retract.

Extension of the first hydraulic ram 32 causes the boom 20 to raise and contraction of the first hydraulic ram 32 causes lowering of the boom 20. Contraction of the second hydraulic ram 34 causes the dipper arm 22, 122 to move in an anti-clockwise direction about pivot 28, i.e. it causes the dipper arm 22, 122 to move in a "dipper out" direction, and extension of the second hydraulic ram 34 causes the dipper arm 22, 122 to move in a clockwise direction about pivot 28, i.e. in a "dipper in" direction. Contraction of the third hydraulic ram causes the bucket 24 to move in an anti-clockwise direction about pivot 30, i.e. in a "dump" direction, and extension of the third hydraulic ram causes the bucket 24 to move in a clockwise direction about pivot 30, i.e. in a "crowd" direction.

In order to dig a trench, an operator uses controls (not shown) in the operator cab 14 to move the boom 20 and dipper arm 22, 122 in a "dipper out" direction thereby moving the bucket 24 away from the chassis 12. The boom 20 is then further lowered such that the bucket teeth (not shown) engage the ground. The bucket 24 is then crowded slightly so as to start to move the bucket teeth (not shown) through the ground. The dipper arm 22,122, boom 20 and bucket 24 are then operated to move the dipper arm 22, 122 in a "dipper in" direction and to move the boom 20 in a "boom raised" direction and to move the bucket 24 in a "crowd" direction such that the bucket teeth move towards the chassis 12 to fill the bucket 24 with ground material. Once the bucket 24 is full, the boom 20 is raised, the arm assembly 18 is swung laterally relative to excavator 10 and the ground material is then dumped by moving the bucket 24 to a "dump" position. The sequence is then repeated. As the bucket 24 is returned to the trench it is positioned closer to the rear of the excavator 10 ready to take the next load of ground material.

The provision of a dipper arm having only single plate or a single laminated structural member reduces the amount of material required to manufacture the dipper arm 22, 122 as compared to conventional box section dipper arms. The single structural member or body 40, 140 is less complex to manufacture and does not require welding of multiple components to provide the required mechanical properties.

The provision of a central portion or spine 74, 174 within the dipper arm 22, 122 provides the strength required to withstand the bending loads that are experienced during operation of the arm assembly 18. In addition, the torsion member 56 provides the torsional strength required to the part of the dipper arm 22, 122 that experiences torsional loads during operation of the arm assembly.

The central portion or spine 74, 174 may also provide bending support to the pivot pins which reduces stresses and may allow smaller diameter pins to be used.

The central portion or spine 74, 174 may also provide wear and crushing support to the front of a lower closing plate. It helps prevent such a surface from "dishing" in. This occurs when a rock or other object is trapped between the attachment and lower closing plate. Conventional arm designs may have optional reinforcements welded to the underside to prevent this, but these would not be needed on this design.

The dipper arm 22, 122 is also advantageous as the inclusion of ram mounts within the single plate 40, 140 removes the need for separate connectors (which are welded to traditional box section dipper arms).

The dipper arm 22, 122 of either embodiment may also include a connector, for example an integral connector, for direct connection of additional attachments, for example a thumb, to the dipper arm 22, 122.

In the embodiment described above, the dipper arm 122 has a single plate 140 including two plate layers 141A, 141B. It will be understood that in alternative embodiments, the single plate structure or body may have any number of plate layers, for example two plate layers or five plate layers or ten plate layers. The number of plate layers included in the single plate structure may correlate to the width of the plate layers.

In the embodiments described above, the dipper arm 22, 122 includes three cut outs. It will be understood that any number of cut outs could be included and the cut outs may be any suitable shape. It will also be understood that in alternative embodiments of the invention, the dipper arm 22, 122 may not include any cut outs. In the embodiment of the dipper arm 122 having a laminate structure, the cut outs (if present) may not extend through all of the plate layers, for example the cut outs (if present) may only extend through one of the plate layers. The cut outs (if present) may extend through an outer plate layer and/or an inner plate layer.

In the embodiments described above, the dipper arm 22, 122 includes a single torsion member 56. It will be understood that the dipper arm may include two or more torsion members in alternative embodiments.

In the example described above, the arm assembly 18 is provided on a tracked excavator. It will be understood that, in alternative embodiments, the arm assembly may be provided on any working vehicle, for example a compact excavator, a heavy excavator or a backhoe loader. In alternative embodiments the arm assembly 18 may be provided on a wheeled excavator, for example a wheeled excavator having a triple articulating boom as shown in FIG. 5. The wheeled excavator 510 has a chassis 512 and an operator cab 514. The operator cab 514 is mounted on the chassis 512. Ground engaging transport means in the form of a pair of rear wheels (only one of which 516A is shown) and a pair of front wheels (only one of which 516B is shown) are provided to move the working vehicle 510. Attached to the chassis 512 is an arm assembly 18. The arm assembly 18 includes a lower boom 520, an upper boom 521, a dipper arm 22 and a bucket 24. The lower arm 520, the upper boom 521, the dipper arm 22 and the bucket 24 are mounted and used as described in relation to the working vehicle 510 of the first embodiment of the invention.

The invention claimed is:

1. An arm assembly for a working vehicle, the arm assembly comprising a material handling implement, a boom, a dipper arm, a first hydraulic ram, and a second hydraulic ram;

the dipper arm having a unitary single plate, a first end, and a second end, the single plate being centrally located when the dipper arm is viewed in cross-section, the single plate having a first end corresponding to the first end of the dipper arm and a second end corresponding to the second end of the dipper arm;

a first portion of the dipper arm disposed between the first and second ends of the dipper arm is pivotally attached to the boom by a first pivot, and a second portion of the dipper arm disposed at the second end of the dipper arm is pivotally attached to the material handling implement by a second pivot;

the first hydraulic ram being operable to pivot the dipper arm relative to the boom, the first hydraulic ram including a first end attached to the boom and a second end having a first clevis, the first clevis being attached to a first clevis eye carried at least by the spine of the single plate at the first end of the dipper arm; and the second hydraulic ram being operable to pivot the material handling implement relative to the dipper arm, the second hydraulic ram including a ram end having a second clevis, the second clevis being attached to a second clevis eye carried only by the spine of the single plate between the first and second ends of the dipper arm.

2. The arm assembly according to claim 1, wherein the single plate includes at least one cut out.

3. The arm assembly according to claim 2, wherein the at least one cut out is formed in a central portion of the single plate.

4. The arm assembly according to claim 1, wherein the single plate further includes a connector for connection to an attachment.

5. The arm assembly according to claim 4, wherein the connector is arranged for direct connection to the attachment.

6. The arm assembly according to claim 1, wherein the single plate is constructed as a laminate and includes a first plate layer and at least one further plate layer, the first plate layer and the at least one further plate layer being arranged to form the single plate as a unitary structure.

7. A working vehicle including ground engaging means, an operator's cab and an arm assembly according to claim 1.

8. An arm assembly for a working vehicle, the arm assembly comprising a material handling implement, a boom, a dipper arm, a first hydraulic ram, and a second hydraulic ram;

the dipper arm having a unitary single plate, a first end, and a second end, the single plate being centrally located when the dipper arm is viewed in cross-section, the single plate having a first end corresponding to the first end of the dipper arm and a second end corresponding to the second end of the dipper arm, the single plate further having an upper surface, a lower surface, an inner face, and an outer face, with the single plate forming a central spine of the dipper arm bounded by the upper and lower surfaces and the inner and outer faces of the single plate;

a first portion of the dipper arm disposed between the first and second ends of the dipper arm is pivotally attached to the boom by a first pivot boss, and a second portion of the dipper arm disposed at the second end of the dipper arm is pivotally attached to the material handling implement by a second pivot boss;

the first hydraulic ram being operable to pivot the dipper arm relative to the boom, the first hydraulic ram including a first end attached to the boom and a second end having a first clevis, the first clevis being attached to a first clevis eye carried at least by the spine of the single plate at the first end of the dipper arm; and the second hydraulic ram being operable to pivot the material handling implement relative to the dipper arm, the second hydraulic ram including a ram end having a second clevis, the second clevis being attached to a second clevis eye carried only by the spine of the single plate between the first and second ends of the dipper arm; and further including an outer torsion member secured to the outer surface of the single plate and an inner torsion member secured to the inner surface of the single plate, the inner and outer torsion members being mounted adjacent to the lower surface of the single plate and spaced away from upper surface and the first clevis eye and the second clevis eye; and wherein the first and second pivot bosses extend through the single plate and the inner and outer torsion members.

* * * * *